US010071890B2

(12) United States Patent
Vik

(10) Patent No.: US 10,071,890 B2
(45) Date of Patent: Sep. 11, 2018

(54) ORBITING FAIRLEAD BLOCK

(71) Applicant: 3DP Modelling AS, Ålesund (NO)

(72) Inventor: Jan Børge Vik, Ålesund (NO)

(73) Assignee: 3DP Modelling AS, Alesund (NO)

( * ) Notice: Subject to any disclaimer, the term of this patent is extended or adjusted under 35 U.S.C. 154(b) by 540 days.

(21) Appl. No.: 14/896,527

(22) PCT Filed: Nov. 7, 2013

(86) PCT No.: PCT/NO2013/050189

§ 371 (c)(1),
(2) Date: Dec. 7, 2015

(87) PCT Pub. No.: WO2014/073977

PCT Pub. Date: May 15, 2014

(65) Prior Publication Data

US 2016/0207745 A1 Jul. 21, 2016

(30) Foreign Application Priority Data

Nov. 7, 2012 (NO) ..... 20121311

(51) Int. Cl.
*B66D 1/36* (2006.01)
*B66D 3/04* (2006.01)
*B63B 21/10* (2006.01)

(52) U.S. Cl.
CPC ..... *B66D 1/36* (2013.01); *B63B 21/10* (2013.01); *B66D 3/04* (2013.01); *B66D 3/046* (2013.01)

(58) Field of Classification Search
CPC .... F16H 55/36; F16H 2055/363; F16H 55/52; B66D 3/04; B66D 3/046; B66D 3/06; B66D 3/08; B63B 21/10
See application file for complete search history.

(56) References Cited

U.S. PATENT DOCUMENTS 569,007 A * 10/1896 Evans ..... B66D 3/04 254/415
596,007 A 12/1897 Neal
(Continued)

FOREIGN PATENT DOCUMENTS

CN 202193582 4/2012
FR 2 868 408 10/2005
(Continued)

OTHER PUBLICATIONS

International Preliminary Report on Patentability dated Mar. 25, 2015 in corresponding International Application No. PCT/NO2013/050189.

(Continued)

*Primary Examiner* — Emmanuel Monsayac Marcelo
(74) *Attorney, Agent, or Firm* — Wenderoth, Lind & Ponack, L.L.P.

(57) ABSTRACT

A fairlead for guiding a cable while maintaining a minimum radius of curvature of said cable, said fairlead comprising: a block with a first and a second side element and at least two pulleys supported between said first and second side element, allowing said pulleys to rotate around parallel axes of rotation; an endless elastic double curved belt in a loop around said at least two pulleys; at least one block carrier bow extending between said first and second side element, wherein said at least one block carrier bow defines an opening with an inner circle segment forming an arch shaped traveling path; a suspension arrangement including at least one traveling bow contact element, said suspension arrangement forming a travelling carriage running along the arch shaped traveling path in a plane parallel to said parallel axes of rotation of said pulleys.

23 Claims, 7 Drawing Sheets

(56) References Cited

U.S. PATENT DOCUMENTS

| | | | | | |
|---|---|---|---|---|---|
| 1,552,161 | A * | 9/1925 | Houghton | B66D 3/04 | 254/134.3 PA |
| 2,269,768 | A | 1/1942 | Keeney | | |
| 2,453,357 | A | 11/1948 | Barkley | | |
| 3,119,601 | A * | 1/1964 | Blount | A01K 73/06 | 254/280 |
| 3,528,645 | A * | 9/1970 | Harken | B66D 3/04 | 254/412 |
| 3,791,625 | A * | 2/1974 | Viljoen | A01K 73/06 | 226/183 |
| 4,354,667 | A * | 10/1982 | Svendsen | A01K 73/12 | 254/332 |
| 4,492,363 | A * | 1/1985 | Niskin | B66D 3/06 | 254/275 |
| 4,760,993 | A | 8/1988 | Du Preez | | |
| 5,149,059 | A * | 9/1992 | Monahan | B63B 21/10 | 254/394 |
| 5,449,154 | A * | 9/1995 | Lob | B66D 3/04 | 254/394 |
| 5,725,200 | A * | 3/1998 | Gordon | B63H 9/10 | 242/157 R |
| 6,375,163 | B1 * | 4/2002 | Carlson | H02G 1/04 | 254/134.3 PA |
| 7,431,269 | B2 * | 10/2008 | Carlson | B66D 3/04 | 254/405 |
| 8,888,072 | B1 * | 11/2014 | Orgeron | B66D 3/046 | 254/393 |
| 9,187,298 | B2 * | 11/2015 | DeSoo | B66D 3/04 | |

FOREIGN PATENT DOCUMENTS

| | | |
|---|---|---|
| JP | 52-110174 | 8/1977 |
| JP | 56-149756 | 11/1981 |
| JP | 7-144850 | 6/1995 |
| SU | 628072 | 8/1978 |
| WO | 89/04560 | 5/1989 |

OTHER PUBLICATIONS

Search Report dated Feb. 23, 2015 in corresponding Norwegian Application No. 20121311.

International Search Report dated Mar. 19, 2014 in corresponding International Application No. PCT/NO2013/050189.

Written Opinion of the International Searching Authority dated Mar. 19, 2014 in corresponding International Application No. PCT/NO2013/050189.

* cited by examiner

Drawings
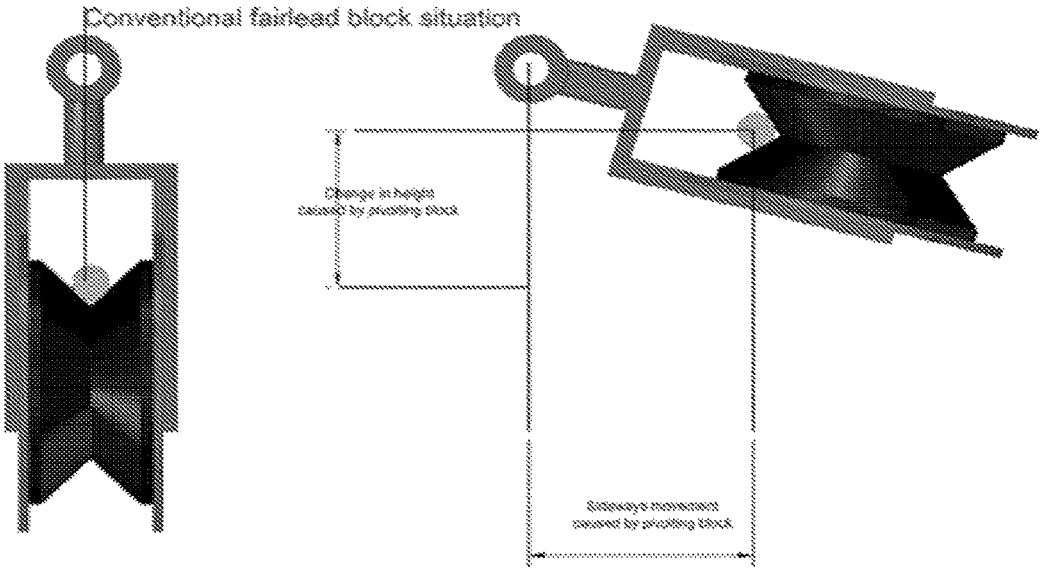
Fig. 1A
Fig. 1B
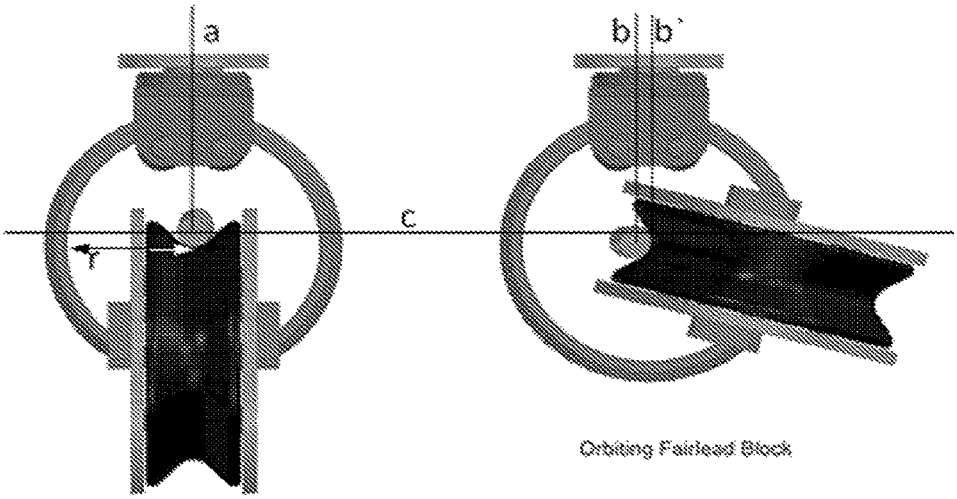
Fig. 2A
Fig. 2B

ORBITING FAIRLEAD BLOCK

TECHNICAL FIELD

The present invention relates to fairlead blocks and in particular to a fairlead block that partly orbits around its suspension during use.

BACKGROUND ART

Traditional fairlead blocks may include a suspension arrangement as depicted in FIGS. 1A and 1B. The block according to the embodiment in FIGS. 1A and 1B pivots around an eye in the figure shown as the upper element of the suspension system of the fairlead block. The pivoting block according to FIGS. 1A and 1B has its centre of rotation at an extreme end relative to the cable, this implies that the cable may be exposed to both sideways and vertical movement. This is in many situations a serious problem as smooth feeding and winding up of cables will be difficult, this is in particular the case in off shore situations onvessels.

DISCLOSURE OF THE INVENTION

A fairlead for guiding a cable while maintaining a minimum radius of curvature of said cable, said fairlead comprising:

a block with a first and a second side element and at least two pulleys supported between said first and second side element, allowing said pulleys to rotate around parallel axes of rotation;

an endless elastic double curved belt in a loop around said at least two pulleys;

at least one block carrier bow extending between said first and second side element, wherein said at least one block carrier bow defines an opening with an inner circle segment forming an arch shaped traveling path;

a suspension arrangement including at least one traveling bow contact element, said suspension arrangement forming a travelling carriage running along the arch shaped traveling path in a plane parallel to said parallel axes of rotation of said pulleys.

The fairlead of according to another embodiment, wherein the least one block carrier bow includes a hinge element and a hinged bow portion; and a fixing device for releasable attachment of the hinged bow portion on the first side element.

The fairlead of another embodiment, including five pulleys.

The fairlead of another embodiment, wherein two, spaced, parallel block carrier bows extend between the first and the second side element;

a suspending plate, forming a part of the suspension arrangement, extending between said spaced parallel block carrier bows, wherein said at least one traveling bow contact element is attached to said suspending plate.

The fairlead of another embodiment, wherein said at least one traveling bow contact element is at least one rolling element.

The fairlead of another embodiment, wherein said at least one traveling bow contact element is at least one rolling element at each side of the suspending plate.

The fairlead of another embodiment, wherein each block carrier bow includes a hinge element and a hinged bow portion; and a fixing device for releasable attachment of each hinged bow portion on the first side element.

The fairlead of another embodiment, wherein said at least one traveling bow contact element is at least one block of a low friction polymer.

Other advantageous features will be apparent from the enclosed claims.

BRIEF DESCRIPTION OF THE DRAWINGS

In order to make the invention more readily understandable, the discussion that follows will refer to the accompanying drawings, in which FIGS. 1A and 1B show a prior art fairlead block, FIGS. 2A and 2B show a fairlead block according to one embodiment of the invention tilted and not tilted relative to the suspension arrangement.

MODE(S) FOR CARRYING OUT THE INVENTION

Figure 3:
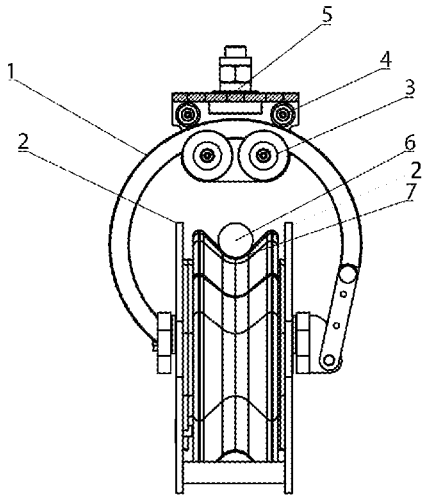
FIG. 3 shows details of a fairlead block according to one embodiment of the invention, including running pulleys for a belt.
Figure 4:
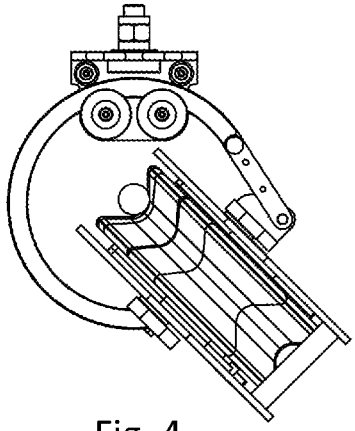
FIG. 4 shows details of a fairlead block according to one embodiment of the invention tilted relative to the suspension arrangement.

The present invention relates to an orbiting fairlead block. In the following discussion it will be adhered to the accompanying drawings; however the drawings are not necessarily to scale nor are all features shown in the drawings mandatory, also some of the features may be excluded. The drawings are meant to ease understanding of the present invention.

In the following discussion the following word may be used interchangeably; Cable and wire; pulley and sheave; bow, clam and elbow, pin, cotter bolt and pivot point.

Traditional fairlead blocks may include a suspension arrangement as depicted in FIGS. 1A and 1B. The block according to the embodiment in FIGS. 1A and 1B pivots around an eye in the figure shown as the upper element of the suspension system of the fairlead block. The pivoting block according to FIGS. 1A and 1B has its centre of rotation at an extreme end relative to the cable, this implies that the cable may be exposed to both sideways and vertical movement.

Contrary to this, according to the present invention it is provided a fairlead block where the centre of rotation is approximately coincident with the cable itself. According to one aspect of the invention the bow 1 (single or double bow) is designed with proportions relative to the one or more pulleys 9 proportions or contact face of the fairlead so that the focal point of the curvature of the bow 1 substantially coincides with the one or more pulleys 9 or sliding surfaces of the fairlead. A design where the centre of rotation coincides with the contact face for guiding a cable with the fairlead provides a smooth feeding and wind up of cable even from a vessel off shore in rough seas. It shall be appreciated that by approximately coincident with the cable itself it is meant that the centre of rotation lies within the radius 1r and two third of the radius r of curvature for the bow 1 ([⅔*r, 1*r]).

An example of a fairlead block according to the principle of the present invention is shown in FIGS. 2A and 2B, it is clearly shown that the sideways and vertical movement of the cable is more or less independent of the tilt angle normal to the cable in contrast with the prior art solution shown in FIGS. 1A and 1B.

It shall be understood that according to an aspect of the invention an opposite arrangement where the bow is fixed to the suspension system and glides through the axis if rotation of the one or more pulleys 9 is also provided. According to all embodiments described herein it shall be understood that the bow 1 can be either fixed in the sense of prohibiting orbiting of the bow at the suspension and allowing orbiting of the bow through the fairlead block or contrary to this by allowing orbiting at the suspension and being fixed at the fairlead block.

According to yet an aspect of all embodiments disclosed herein the bow 1 might be rotate/orbit freely with respect to the suspension arrangement and with respect with the fairlead block.

In the following particular embodiments of equal importance will be described with support in the drawings, however not limited by the features shown in the drawings.

A First Embodiment of the Present Invention

The first embodiment of the invention is shown in FIGS. 2A and 2B. According to the first embodiment of the invention it is provided a fairlead block comprising one single pulley 9. Said fairlead comprises a block with a first 2 and a second side element 2 and the pulley 9 supported between the first 2 and second side element 2. An axis of rotation is provided normal to and between the side elements said axis of rotation is the axis of rotation for the pulley. The fairlead block further comprises one block carrier bow 1 extending between said first 2 and second side element 2. The block carrier bow 1 defines an opening with an inner circle segment forming an arch shaped traveling path. The fairlead also comprises a suspension arrangement 5 which includes at least one traveling bow contact element 3, 4. The contact elements can be any of: rollers, ball races, low friction or contact surface or any low friction arrangement known to the person skilled in the art. The suspension arrangement forms a travelling carriage running along the arch shaped traveling path in a plane parallel to said parallel axes of rotation of the pulley 9 so that the block carrier bow 1 is engaged with the suspension arrangement and thus provides an orbiting fairlead. The fairlead according to the first embodiment may be provided with a link swivel 5 at its upper end relative to the pulley. The optional link swivel provides an upper pivot point for the suspension arrangement which will facilitate rotation of the fairlead block normal to the axis of rotation for the pulley.

In FIGS. 2A and 2B it is shown a pulley with one groove adapted for one cable, according to one aspect of the first embodiment the pulley 9 may be provided with numerous grooves for numerous cables.

In FIGS. 2A and 2B it is shown a pulley which is according to the above is adapted to rotate about an axis of rotation, however according to one aspect of the first embodiment the pulley may be provided with a low friction surface and it may then be fixed to the side elements 2. It shall be understood that the pulley may be interchanged with a fixed contact surface having a low friction surface, which makes it possible to feed and wind up one or more cables.

Figure 5:
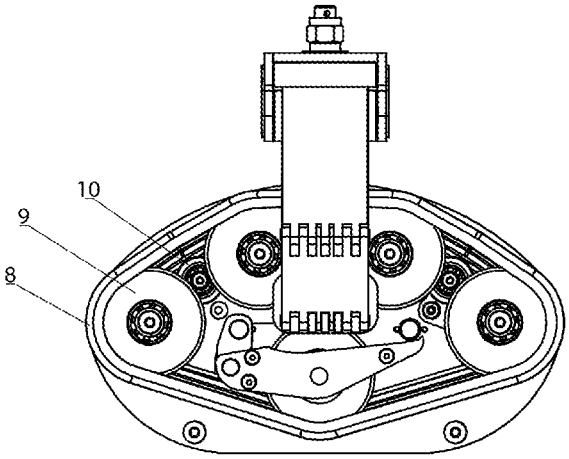
FIG. 5 shows exploded details of a fairlead block according to one embodiment of the invention.
Figure 6:
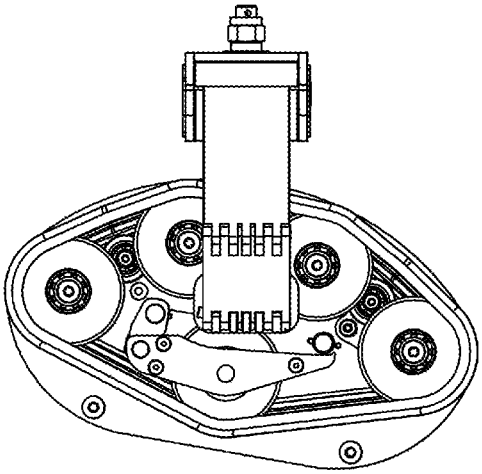
FIG. 6 shows a fairlead block according to one embodiment of the invention in a tilted position.
Figure 7:
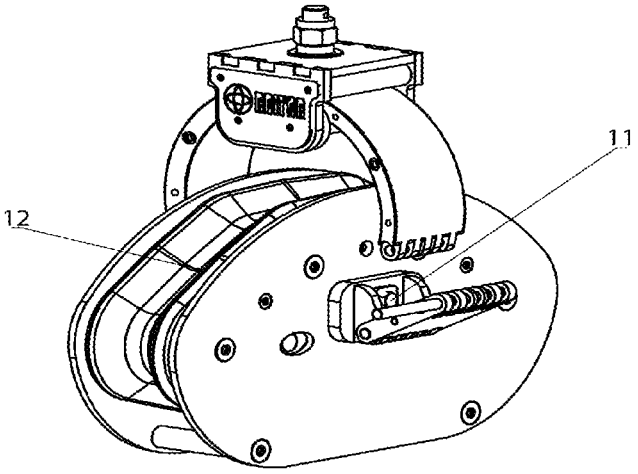
FIG. 7 shows a fairlead block according to one embodiment of the invention in invention where one bow is in an open position.
Figure 8:
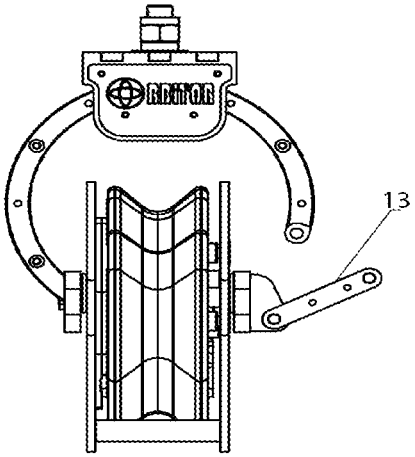
FIG. 8 shows a fairlead block according to one embodiment of the invention in invention where one bow is in an open position.

It shall be appreciated that the bow 1 can be provided with one or two split links 13 for cable inlet. Moreover the bow 1 according to the first embodiment is a single bow as shown in FIGS. 5-7.

It shall be appreciated that according to one aspect of the first embodiment an opposite arrangement for orbiting the fairlead may be provided, as indicated above where the bow can be fixed to the suspension arrangement.

A Second Embodiment of the Present Invention

Figure 11:
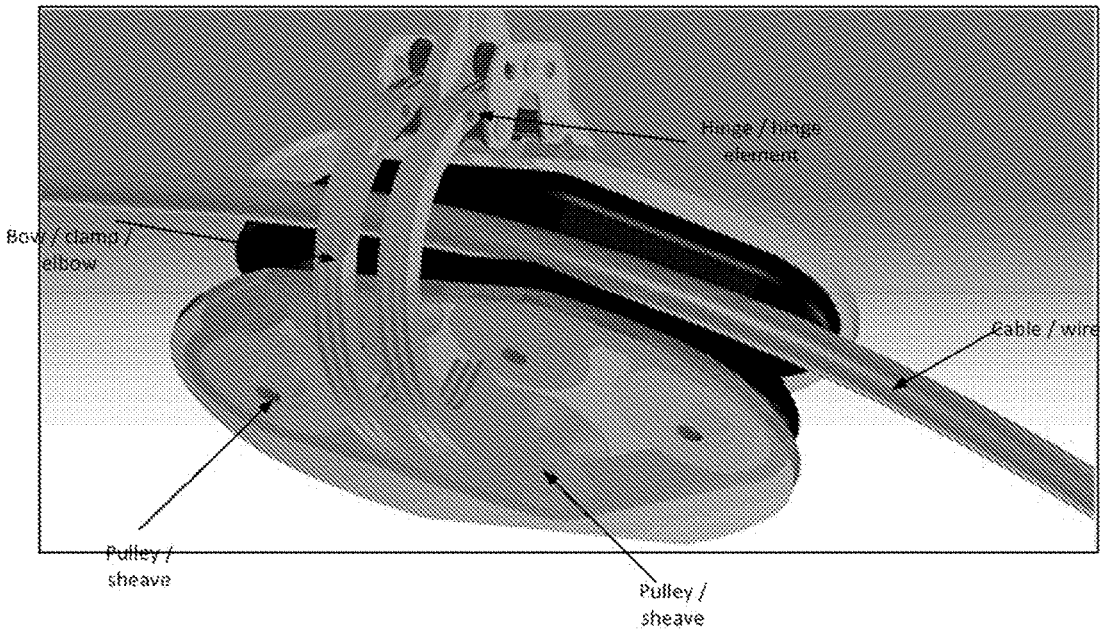
FIG. 11 shows details of a fairlead block according to one embodiment of the invention, including running pulleys for a belt.
Figure 12:
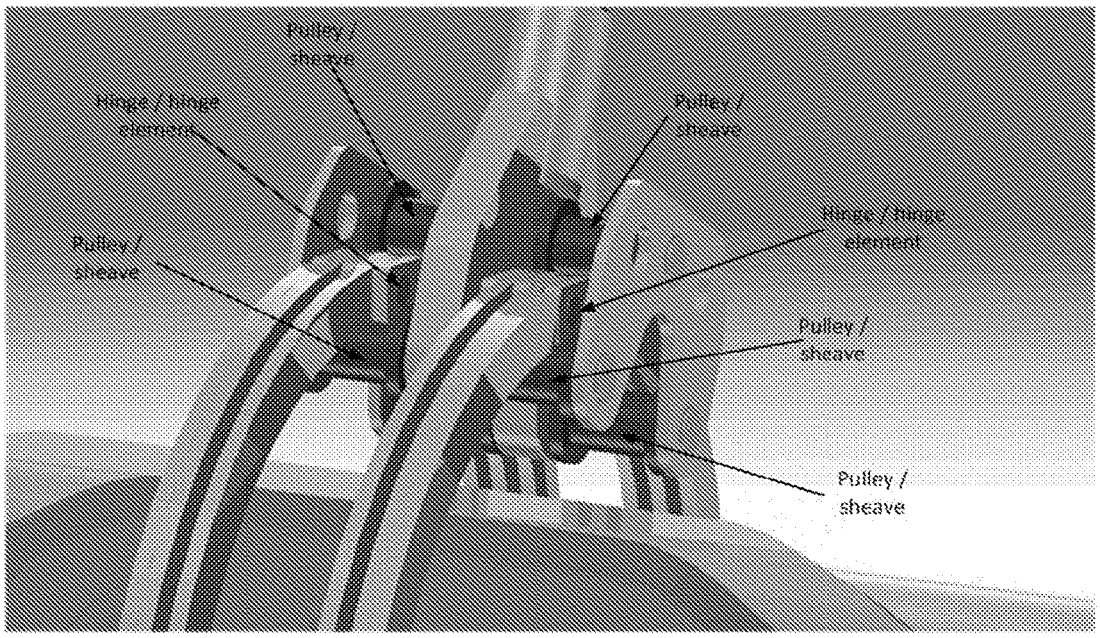
FIG. 12 shows details of a fairlead block according to one embodiment of the invention including pulleys for the one or more bows.
Figure 13:
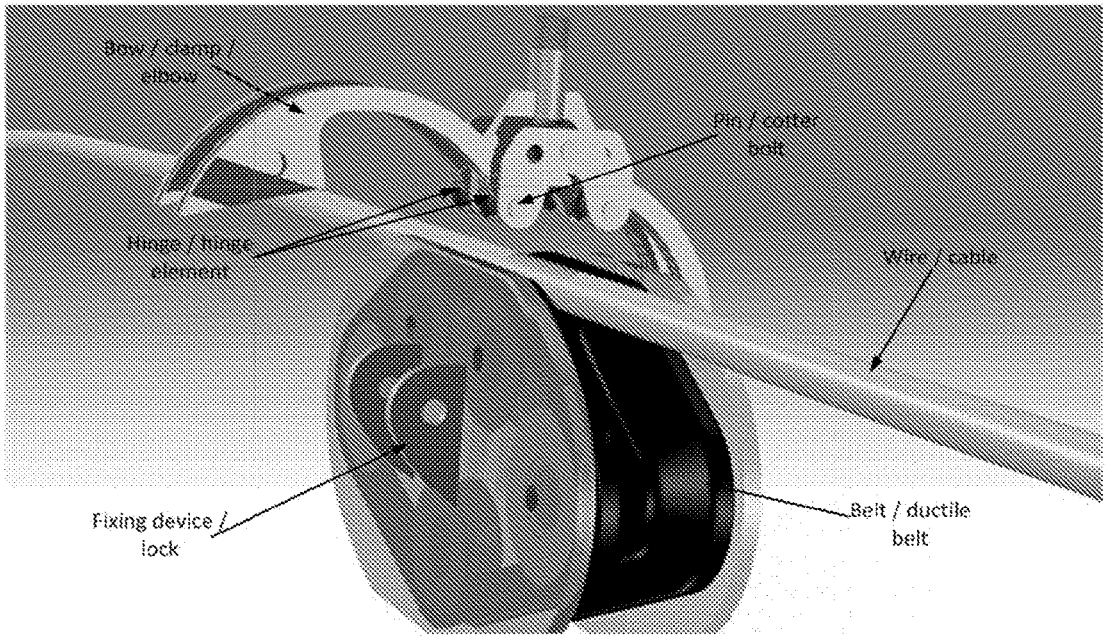
FIG. 13 shows details of a fairlead block according to one embodiment of the invention where the one or more bows are in an open position.

The second embodiment of the invention is shown in FIGS. 2A and 2B. The second embodiment according to the invention differs from the first embodiment by the design of the bow 1. According to the second embodiment of the invention the bow 1 is a double bow as shown in FIGS. 11-13. The suspension system may be provided with threads or a swivel according to the first embodiment. The double bow is adapted to be fixed to the fairlead block housing. Further the double bow is attached to a suspension arrangement. The double bow includes hinges which make it possible to pivot the double bow around an axis of rotation defined by the hinge(s).

It shall be appreciated that according to one aspect of the second embodiment an opposite arrangement for orbiting the fairlead may be provided, as indicated above, where the double bow is fixed to a suspension arrangement.

A Third Embodiment of the Present Invention

FIGS. 3 to 8 show examples of a fairlead block having a multiple of pulleys 9 according to a third embodiment of the present invention. The pulleys rotate freely and have their axis of rotation substantially normal to the side elements 2 of the fairlead block. An axis of rotation is provided normal to and between the side elements. Said axis of rotation is the axis of rotation for the multiple pulleys 9. The fairlead block may comprise any suitable number of pulleys and the size of the pulleys are not necessarily the same. The configuration of the pulleys is a matter of design. The rationale behind using multiple of pulleys 9 is that it will provide a minimum curvature of one or more cables guided by the fairlead, without adding the size of the block as much as it would if a large diameter pulley was used.

In accordance to one aspect of the third embodiment the fairlead is provided with rollers 10 which rotates freely and have their axis of rotation substantially normal to the side elements 2 of the fairlead block. The rollers may be dimensioned so that they overlap with the extreme edge of the pulleys 9 as shown in FIGS. 5 and 6. This can be achieved by having a breadth of the rollers that is substantially smaller than that of the pulleys 9. According to one aspect of the third embodiment the fairlead block includes three pulleys, in accordance with another aspect of the third embodiment the fairlead block includes four pulleys, in accordance with yet an aspect of the third embodiment of the invention the fairlead block includes five pulleys and in yet another aspect of the third embodiment of the fairlead block includes six pulleys. In a final aspect of the invention the fairlead includes more than six pulleys 9.

The fairlead block further comprises one block carrier bow 1 extending between said first 2 and second side element 2. The block carrier bow 1 defines an opening with an inner circle segment forming an arch shaped traveling path. The fairlead also comprises a suspension arrangement 5 which includes at least one traveling bow contact element 3, 4. The contact elements can be any of: rollers, ball races, low friction or contact surface or any low friction arrangement known to the person skilled in the art. The suspension arrangement forms a travelling carriage running along the arch shaped traveling path in a plane parallel to said parallel axes of rotation of the pulley 9 so that the block carrier bow 1 is engaged with the suspension arrangement and thus provides an orbiting fairlead. The fairlead according to the first embodiment may be provided with a link swivel 5 at its upper end relative to the pulley. The optional link swivel provides an upper pivot point for the suspension arrangement which will facilitate rotation of the fairlead block normal to the axis of rotation for the pulley.

In FIGS. 3-8 it is shown a fairlead with a belt 7, 8, 12 with one groove adapted for one cable. According to the above the pulleys 9 are adapted to rotate about axis' of rotation, however according to one aspect of the first embodiment the pulleys may be provided with a low friction surface and they may then be fixed to the side elements 2. It shall be understood that the pulleys may be interchanged with a fixed contact surface having a low friction surface, which makes it possible to feed and wind up one or more cables.

It shall be appreciated that the bow 1 can be provided with one or two split links 13 for cable inlet. Moreover the bow 1 according to the first embodiment is a single bow as shown in FIGS. 5-7.

It shall be appreciated that according to one aspect of the third embodiment an opposite arrangement for orbiting the fairlead may be provided, as indicated above where the bow can be fixed to the suspension arrangement.

A Fourth Embodiment of the Present Invention

The fourth embodiment of the invention is shown in FIGS. 9-13. The fourth embodiment according to the invention differs from the third embodiment by the design of the bow 1. According to the fourth embodiment of the invention the bow 1 is a double bow as shown in FIGS. 11-13. The suspension system may be provided with threads or a swivel according to the first embodiment. The double bow is adapted to be fixed to the fairlead block housing. Further the double bow is attached to a suspension arrangement. The double bow includes hinges which make it possible to pivot the double bow around an axis of rotation defined by the hinge(s).

It shall be appreciated that according to one aspect of the fourth embodiment an opposite arrangement for orbiting the fairlead may be provided, as indicated above, where the double bow is fixed to a suspension arrangement.

A Fifth Embodiment of the Present Invention

Reference is made to the FIGS. 3 to 8 with respect to the fifth embodiment of the present invention. The fifth embodiment of the invention differs from the third embodiment of the invention as the fairlead further comprises an endless belt 7, 8, 12 in a loop around the pulleys 9.

The endless belt 7, 8, 12 may be elastic and as shown in the figures may be double curved. In another aspect of the fifth embodiment the endless belt has s substantially flat/even surface, in yet an aspect the belt is provided with a plurality of grooves adapted to receive a plurality of cables.

In yet an embodiment of the invention the belt is a multi rib belt adapted to be used with pulleys/rollers/idler rollers with grooves adapted for multi rib belts.

In the exploded view of the fairlead block shown in FIGS. 5 and 6 it can be seen that the fairlead is provided with a belt tensioner mechanism. This belt tensioner mechanism is in engagement with one of the pulleys 9, in the figures the mechanism is in engagement with the lowermost pulley of the fairlead.

A Sixth Embodiment of the Present Invention

The sixth embodiment of the invention is shown in FIGS. 9-13. The sixth embodiment according to the invention differs from the fifth embodiment by the design of the bow 1. According to the sixth embodiment of the invention the bow 1 is a double bow as shown in FIGS. 11-13. The suspension system may be provided with threads or a swivel according to the first embodiment. The double bow is adapted to be fixed to the fairlead block housing. Further the double bow is attached to a suspension arrangement. The double bow includes hinges which make it possible to pivot the double bow around an axis of rotation defined by the hinge(s).

It shall be appreciated that according to one aspect of the sixth embodiment an opposite arrangement for orbiting the fairlead may be provided, as indicated above, where the double bow is fixed to a suspension arrangement.

A Seventh Embodiment of the Present Invention

In accordance with a seventh embodiment it is provided a fairlead that will provide a minimum curvature of one or more cables guided by the fairlead, without adding the size of the block as much as it would if a large diameter pulley was used. In accordance with this embodiment the fairlead is provided with a belt which is in engagement with a groove in inside of the side elements 2, the engagement is a low friction engagement hence providing for rotation of the belt. In yet an aspect of the seventh embodiment it is provided a belt with an outer contact face which is of a low friction types which will facilitate feeding and wind up of cables.

Further Aspects of the Third, Fourth, Fifth, Sixth and Seventh Embodiment of the Invention According to further aspects of the third, fourth, fifth, sixth and seventh embodiment of the invention it is provided a pivot point 11 for the fairlead block, which facilitates tilting of the fairlead block as can be seen in FIG. 6.

Further Description of the Enclosed Drawings

Figure 9:
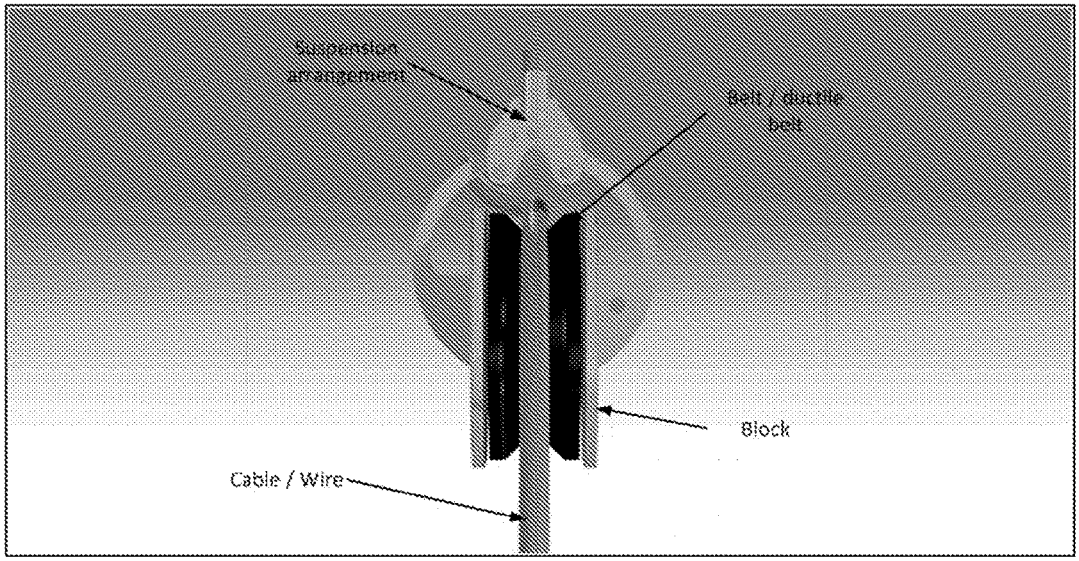
FIG. 9 shows a fairlead block according to one embodiment of the invention.

FIG. 9 discloses a fair lead block according to one embodiment of the invention seen in parallel with a cable/ wire. The cable can be any type of a cable, and the block can be used wherever the need for an orbiting block is present.

Figure 10:
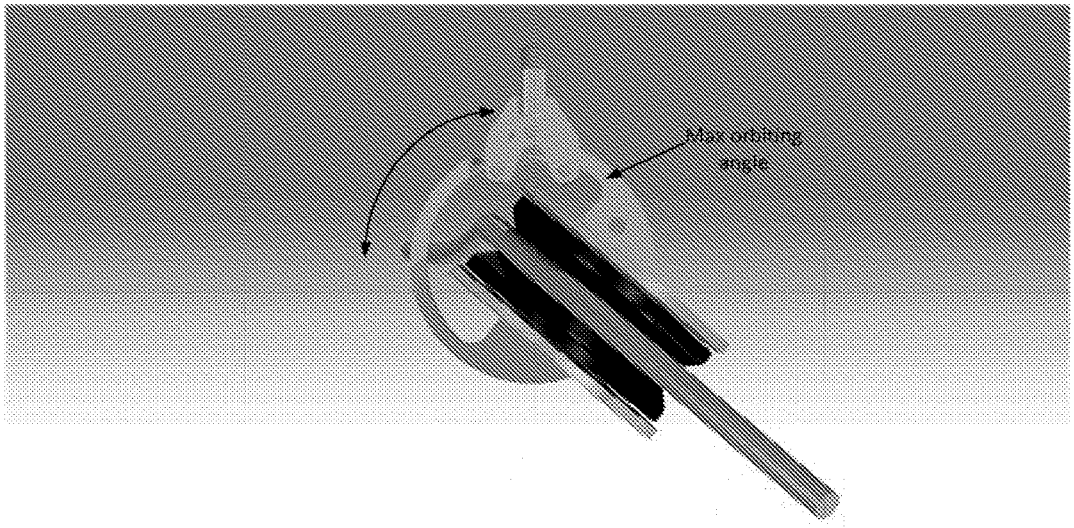
FIG. 10 shows a fairlead block according to one embodiment of the invention tilted relative to the suspension arrangement.

FIG. 10 shows the orbiting block in a tilted position compared with that of FIG. 1A. The block may orbit/pivot in at least +/−90 degrees compared with the vertical position indicated in FIG. 1A. The maximum angle of tilt is a matter of design of the at least one bows fixing arrangement to the block.

FIG. 11 shows the fairlead block in details, it can be seen that a belt is running on a number of pulleys, where the pulleys rotates freely and have their axis of rotation substantially normal to the outer walls of the block housing. To achieve the object of the invention at least two pulleys are needed, the fairlead block may comprise any suitable number of pulleys and the size of the pulleys are not necessarily the same. The configuration of the pulleys is a matter of design. According to one embodiment of the fairlead block includes three pulleys, in accordance with another embodiment the fairlead block includes four pulleys, in accordance with yet an embodiment of the invention the fairlead block includes five pulleys and in yet another embodiment the fairlead block includes six pulleys.

FIG. 11 further shows two circular shaped bows, the bows are adapted to be fixed to the fairlead block housing. Further the bows are attached to a suspension arrangement. The bows include hinges which make it possible to pivot the at least one bow around an axis of rotation defined by the hinge(s).

FIG. 12 shows details related to the bow and suspension arrangement of the fairlead block. The figure shows the hinge elements described above moreover a number of pulleys are arranged in the suspension arrangement. These pulleys facilitate the orbiting behaviour of the fairlead block, as the bows runs on the pulleys. In the figure the pulley configuration includes three pulleys for each bow. However other configurations may apply, the bows may run on any sliding surface.

FIG. 13 shows details related to the bow and suspension arrangement of the fairlead block where the bows are shown in an open position, this facilitates the installation of a cable or wire. It can be seen that the bow(s) includes hinge elements. These elements may be provided on one part of the bow(s) as disclosed in FIG. 6 or hinges may be provided symmetrically with respect to the vertical centre line of the suspension arrangement on both sides of this vertical centre line. With two hinges on each bow(s) a curved spacer is inserted in between said hinges.

The figure also shows the belt running on a number of pulleys, the belt according to the embodiment disclosed in FIG. 6 may be a double curved belt.

The figure also shows the fixing device mounted the housing of the fairlead block. This fixing device secures the bow(s) in a locked position during operation of the fairlead block.

Figure 14:
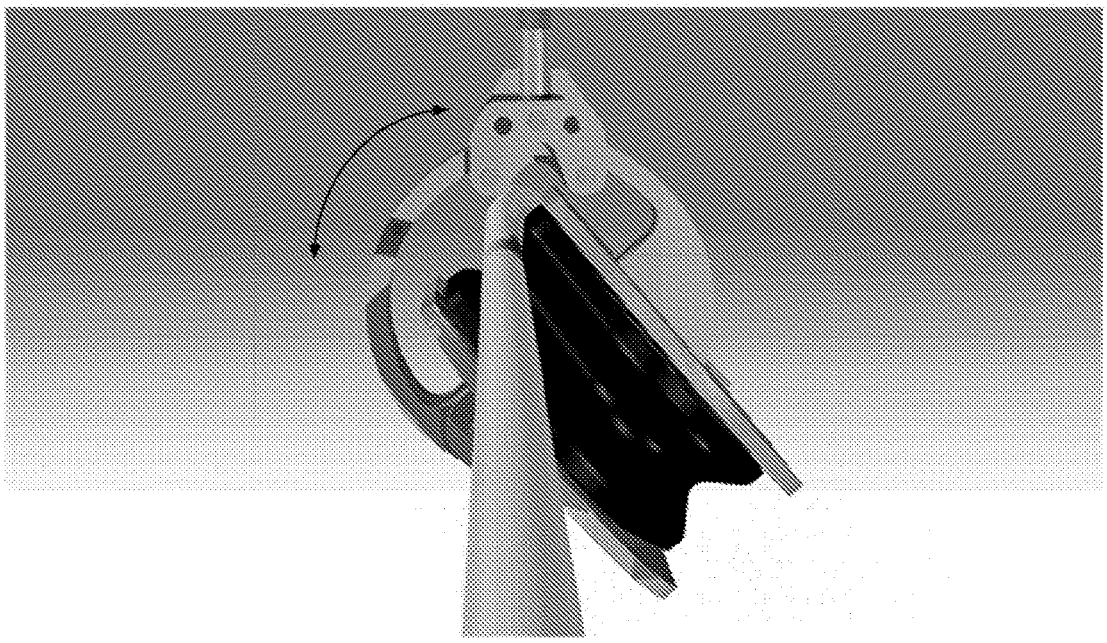
FIG. 14 shows a fairlead block according to one embodiment of the invention tilted with relative to the suspension arrangement.

FIG. 14 shows the fairlead block in a tilted position.

The pulleys in the suspension arrangement may be adapted to be rollers for a curved surface—concave or convex.

REFERENCE NUMERAL TO THE FIGURES

1. Torus/Ring
2. Fairlead chassis
3. Roller
4. Roller
5. Link swivel
6. Cable
7. Belt
8. Belt
9. Fairlead Pulley
10. Fairlead Roller
11. Pivot Point
12. Belt
13. Split link for cable inlet

The invention claimed is:

1. A fairlead for guiding a cable, said fairlead comprising:
a block with a first and a second side element and at least one pulley supported between said first and second side element, allowing said at least one pulley to rotate around parallel axes of rotation;
at least one block carrier bow extending between said first and second side element, wherein said at least one block carrier bow defines an opening with an inner circular segment forming an arch shaped traveling path; and
a suspension arrangement including at least one traveling bow contact element, said suspension arrangement forming a travelling carriage running along the arch shaped traveling path in a plane parallel to said parallel axes of rotation of said at least one pulley, wherein
said at least one pulley has a circumferential contact surface, and
said at least one block carrier bow in engagement with the suspension arrangement provides an orbital fairlead having a center of rotation of the inner circular segment coinciding with the circumferential contact surface being closest to the suspension arrangement.

2. The fairlead of claim 1, wherein the block with the first and the second side element comprises at least two pulleys supported between said first and second side element, allowing said at least two pulleys to rotate around parallel axes of rotation.

3. The fairlead of claim 1, wherein said at least one pulley comprises at least two pulleys, and said fairlead further comprises an endless elastic belt in a loop around said at least two pulleys.

4. The fairlead of claim 3, wherein the endless elastic belt is double curved.

5. The fairlead of claim 1, wherein the least one block carrier bow includes a hinge element and a hinged bow portion, and
a fixing device for releasable attachment of the hinged bow portion on the first side element.

6. The fairlead of claim 1, wherein the block with the first and the second side element includes five pulleys.

7. The fairlead of claim 1, wherein two, spaced, parallel block carrier bows extend between the first and the second side element,
a suspending plate, forming a part of the suspension arrangement, extends between said spaced parallel block carrier bows, and said at least one traveling bow contact element is attached to said suspending plate.

8. The fairlead of claim 7, wherein said at least one traveling bow contact element is at least one rolling element at each side of the suspending plate.

9. The fairlead of claim 7, wherein each block carrier bow includes a hinge element and a hinged bow portion, and
a fixing device for releasable attachment of each hinged bow portion on the first side element.

10. The fairlead of claim 1, wherein said at least one traveling bow contact element is at least one rolling element.

11. The fairlead of claim 1, wherein said at least one traveling bow contact element is at least one block of a low friction polymer.

12. A fairlead for guiding a cable, said fairlead comprising:

a block with a first and a second side element and at least one pulley supported between said first and second side element, allowing said at least one pulley to rotate around parallel axes of rotation;

at least one block carrier bow extending between said first and second side element, wherein said at least one block carrier bow defines an opening with an inner circular segment forming an arch shaped traveling path; and a suspension arrangement including at least one traveling bow contact element, said suspension arrangement forming a travelling carriage running along the arch shaped traveling path in a plane parallel to said parallel axes of rotation of said pulleys so that the block carrier bow in engagement with the suspension arrangement provides an orbiting fairlead, wherein two, spaced, parallel block carrier bows extend between the first and the second side element, a suspending plate, forming a part of the suspension arrangement, extends between said spaced parallel block carrier bows, and said at least one traveling bow contact element is attached to said suspending plate.

13. The fairlead of claim 12, wherein the block with the first and the second side element comprises at least two pulleys supported between said first and second side element, allowing said at least two pulleys to rotate around parallel axes of rotation.

14. The fairlead of claim 12, wherein said at least one pulley comprises at least two pulleys, and said fairlead further comprises an endless elastic belt in a loop around said at least two pulleys.

15. The fairlead of claim 14, wherein the endless elastic belt is double curved.

16. The fairlead of claim 12, wherein the least one block carrier bow includes a hinge element and a hinged bow portion, and a fixing device for releasable attachment of the hinged bow portion on the first side element.

17. The fairlead of claim 12, wherein the block with the first and the second side element comprises five pulleys.

18. The fairlead of claim 12, wherein said at least one traveling bow contact element is at least one rolling element.

19. The fairlead of claim 12, wherein said at least one traveling bow contact element is at least one rolling element at each side of the suspending plate.

20. The fairlead of claim 12, wherein each block carrier bow includes a hinge element and a hinged bow portion, and a fixing device for releasable attachment of each hinged bow portion on the first side element.

21. The fairlead of claim 12, wherein said at least one traveling bow contact element is at least one block of a low friction polymer.

22. A fairlead for guiding a cable, said fairlead comprising:

an endless elastic belt;

a block with a first and a second side element and at least one pulley supported between said first and second side element, allowing said at least one pulley to rotate around parallel axes of rotation;

at least one block carrier bow extending between said first and second side element, wherein said at least one block carrier bow defines an opening with an inner circular segment forming an arch shaped traveling path; and a suspension arrangement including at least one traveling bow contact element, said suspension arrangement forming a travelling carriage running along the arch shaped traveling path in a plane parallel to said parallel axes of rotation of said pulleys so that the block carrier bow in engagement with the suspension arrangement provides an orbiting fairlead, wherein said at least one pulley comprises at least two pulleys, and said endless elastic belt is in a loop around said at least two pulleys.

23. The fairlead of claim 22, wherein the endless elastic belt is double curved.

* * * * *